US009360275B2

(12) United States Patent
de Nijs

(10) Patent No.: US 9,360,275 B2
(45) Date of Patent: Jun. 7, 2016

(54) HOLSTER WITH REMOVABLE COVER

(76) Inventor: Kurt H. de Nijs, Westerville, OH (US)

( * ) Notice: Subject to any disclaimer, the term of this patent is extended or adjusted under 35 U.S.C. 154(b) by 386 days.

(21) Appl. No.: 12/906,956

(22) Filed: Oct. 18, 2010

(65) Prior Publication Data

US 2012/0091175 A1 Apr. 19, 2012

(51) Int. Cl.

| | |
|---|---|
| ***A45F 5/00*** | (2006.01) |
| ***F41C 33/02*** | (2006.01) |
| ***F41C 33/04*** | (2006.01) |

(52) U.S. Cl.

CPC ..... *F41C 33/0209* (2013.01); *F41C 33/04* (2013.01); *A45F 2200/0591* (2013.01)

(58) Field of Classification Search

CPC ..... F41C 33/02
USPC ..... 224/238–240, 236, 243, 193, 192, 911, 224/912, 198; 150/154
See application file for complete search history.

(56) References Cited

U.S. PATENT DOCUMENTS

| | | | | | |
|---|---|---|---|---|---|
| 3,630,420 | A | * | 12/1971 | Bianchi | 224/193 |
| 3,902,639 | A | | 9/1975 | Rogers | |
| 4,340,437 | A | | 7/1982 | Rogers | |
| 4,485,947 | A | | 12/1984 | Cook | |
| 4,591,081 | A | * | 5/1986 | Bianchi et al. | 224/192 |
| 4,627,558 | A | | 12/1986 | Bianchi et al. | |
| 4,694,980 | A | | 9/1987 | Rogers | |
| 5,065,879 | A | * | 11/1991 | King | 220/739 |
| 5,318,821 | A | * | 6/1994 | Bradley, Jr. | 428/100 |
| 5,351,868 | A | | 10/1994 | Beletsky et al. | |
| 5,392,975 | A | * | 2/1995 | Blankenship, Jr. | 224/148.5 |
| 5,477,999 | A | * | 12/1995 | Blankenship, Jr. | 224/666 |
| 5,562,229 | A | * | 10/1996 | Callahan | 220/694 |
| 5,961,013 | A | * | 10/1999 | Collins | 224/244 |
| 5,997,787 | A | | 12/1999 | Nelson et al. | |
| 6,050,465 | A | | 4/2000 | Nelson et al. | |
| 7,028,730 | B2 | * | 4/2006 | Pace et al. | 150/105 |
| 2002/0047029 | A1 | * | 4/2002 | Liao | 224/244 |
| 2005/0279789 | A1 | * | 12/2005 | Lowe | 224/244 |
| 2012/0181311 | A1 | * | 7/2012 | Stevens, IV | 224/197 |

OTHER PUBLICATIONS 5.11 Tactical, Gun HolsterlTatical Holster/5.11Tatical product webpage, copyright 2011, 1 page, retrieved May 13, 2011 at http://www.511tactical.com/All-Products/Accessories/Holster.html.

Bianchi, Bianchi Leather Holster, Concealment Holster, Duty Holsters and Duty Gear product webpages, copyright, 2010, 9 pages, retrieved Jan. 19, 2011 at http://www.bianchi-intl.com.

Blackhawki, Holster, Gun Holsters for Glock, Beretta, & Ruger, SERPA Holster product webpages, 18 pages, retrieved Jan. 19, 2011 at http://www.blackhawk.com/catalog/Holsters,16.htm.

(Continued)

*Primary Examiner* — Brian D Nash
(74) *Attorney, Agent, or Firm* — Shaddock Law Group, PC

(57) ABSTRACT

A holster adapted worn by an individual as a means of containing an item. An exemplary embodiment comprises a containing means with an inside and an outside surface where the containing means may be selectively connected to a covering means via a securing means. In preferred exemplary embodiments, the covering means covers substantially all or a portion of the outside surface of the containing means so that it protects the containing means from wear. The covering means may be reversible offering users the ability to have different holster surfaces in the same unit.

20 Claims, 15 Drawing Sheets

(56) References Cited

OTHER PUBLICATIONS

Blade-Tech Industries, Blade-Tech Leather Series Holster :: Blade-Tech Industries, Copyright 2001-2011, product webpages, 18 pages, retrieved at http://www.blade-tech.com/Blade-Tech-Leather-Series-Holsters-c-363.html.
Boston Leather, bostonleather.com, product webpages, copyright 2010, Sterling, IL, 3 pages, retrieved Jan. 21, 2011 at http://www.bostonleather.com.
DeSantis Gunhide, DeSantis product webpages, copyright 2011, 17 pages retrieved Jan. 21, 2011 at http://www.desantisholstercom/.
Fobus Holsters & Pouches, product webpages, 57 pages, pages retrieved Jan. 21, 2011 at http://www.fobusholster.com/.
Galco, Galco holster; Holster; Gun holster, pistol holster, western holsters, shoulder holster, leather holster and Glock holsters, product webpages, 14 pages, pages retrieved May 13, 2011 at http://www.usgalco.com/HolsterPT2.asp.
Gould & Goodrich, product webpages and catalog, copyright 2011, 52 pages, retrieved May 13, 2011 at http://www.gouldusa.com.
Safariland, "Model 070 Level III Retention Duty Holster, SSIII Mid-Ride", copyright 2000-2010, 6 pages, webpage retrieved May 16, 2011 at http://www.safariland.com/DutyGear/product.aspx?pix=70.
Sarfariland, "Model 518 Paddle Holster", copyright 2000-2010, 6 pages, webpage retrieved May 16, 2011 at http://www.safariland.com/DutyGear/product.aspx?pid=518.
Sarfariland, "Model 6280 Level II Retention Duty Holster, Mid-Rid",copyright 2000-2010, 19 pages, webpage retrieved May 16, 2011 at http://www.safariland.com/DutyGear/product.aspx?pid=6280.
Safariland, product webpages, 7 pages, copyright 2000-2010, webpages retrieved Jan. 19, 2011 at http://www.safariland.com.
Stallion Leather, product webpages, 4 pages, copyright 2008, webpages retrieved May 16, 2011 at http:www.stallionleather.com.
Strong, product webpages, 6 pages, Gloucester, MA, webpages retrieved May 16, 2011 at http:www.pexhost.com/ . . . 7446 &source=launch&ref=http%3A%2f%Fwww.ask.com%2Fweb%3Fq%3Dstrong%2Bholster%26o%3D15080%2-61%3D2871.
Tex Shoemaker & Sons Inc., product webpages, 6 pages, webpages retrieved May 16, 2011 at http://www.texshoemakercom/Duty-Holster_c2htm.
Uncle Mike's, product webpages, 26 pages, copyright 2007, webpages retrieved Jan. 19, 2011 at http://www.unclemikes.com/.
Uncle Mike's, model 5400, 3 pages, copyright 2011, webpages retrieved May 16, 2011 at http:www.shopunclemikes.com/detail/TCL+UM15+0+R.
Eagle Industries, product webpages, 10 pages, copyright 2007-2011, webpages retrieved May 27, 2011 at http:www.eagleindustries.com/home.php?cat=.
Uncle Mike's, model pro 3, 2 pages, copyright 2011, webpages retrieved May 16, 2011 at http:www.shopunclemikes.com/products/index.cfm?ClassID=7&ClassCategoryID=1&FamilyID=1.

* cited by examiner

FIG. 7
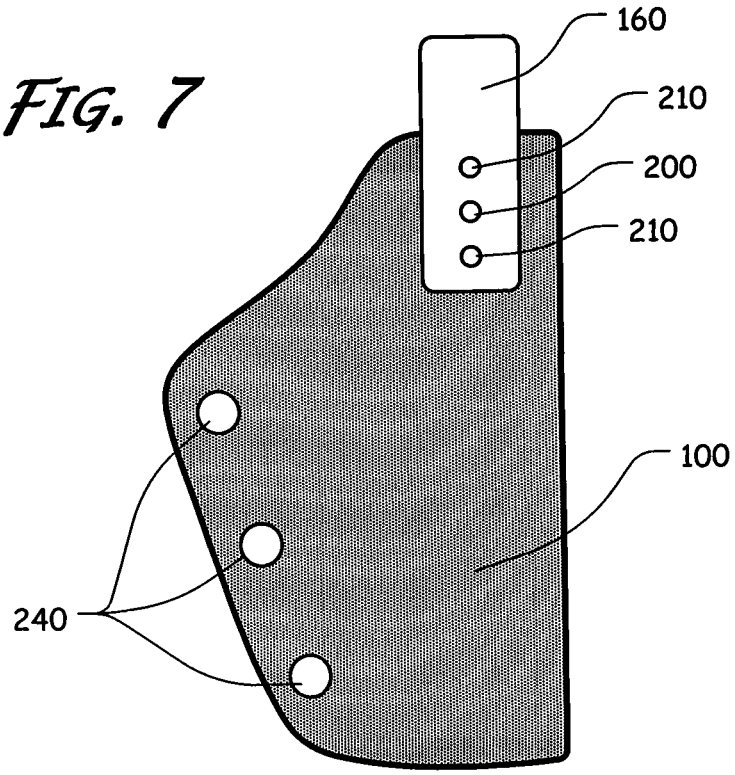
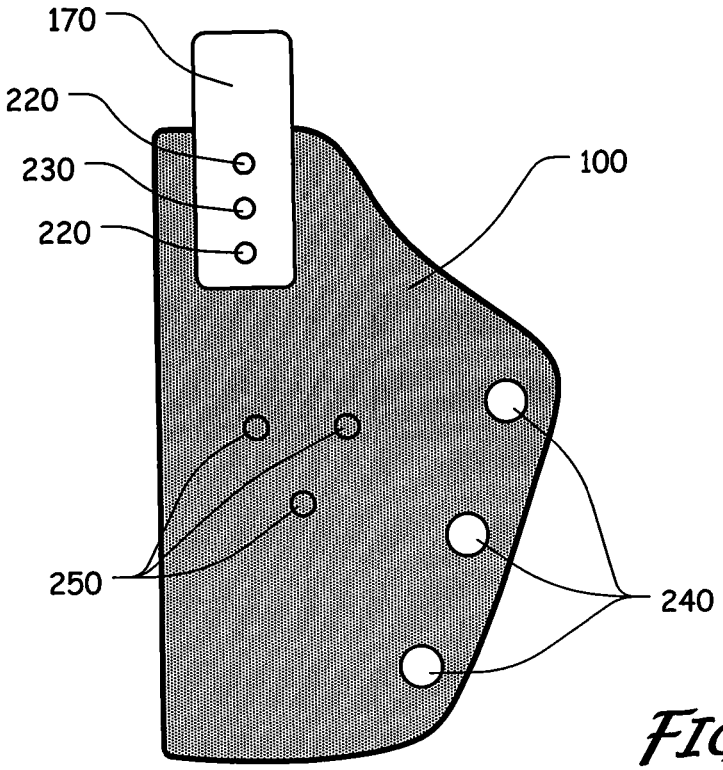
FIG. 8

HOLSTER WITH REMOVABLE COVER

FIELD OF THE INVENTION

The present invention relates generally to holsters. In particular, exemplary embodiments of the invention relate to a holster for containing and/or protecting items such as but not limited to a gun, chemical agent, weapon, electrical discharge "stunning" device, power tool, knife, pager, radio, pda, telephone, and other similar communication and computing device, etc., where the holster comprises a containing means, a cover adapted to fit about the containing means, and a securing means that selectively holds the cover in a desired position about the containing means.

BACKGROUND AND SUMMARY OF THE INVENTION

A holster is a device used to contain or restrict the undesired movement of an item, such as a handgun, most commonly in a location where it can be easily withdrawn for immediate use. Holsters can also be utilized to contain items such as knives, chemical agents, batons and other impact weapons, power tools, etc. Because the item being contained by the holster is often times repeatedly inserted and subsequently removed from the holster—often at a quick rate—a holster is subjected to many different elements and can be worn down. Moisture can do damage internally as well. Moisture, abrasion caused by many sources, temperature extremes, and even sunlight are but a few examples of the conditions and elements that can cause wear and damage to a holster's exterior. In many professions such as those of law enforcement and the military, maintaining a certain level of appearance is desired or required. Thus, when the holster begins to look worn, or in the case of leather contaminated or stained by substances such as water, chemicals of all sorts, and various bodily fluids, the entire holster needs to be replaced. This is done regardless of whether the rest of the holster is in working condition. There might also be a need to change out the covering, though there is no wear at all. A law enforcement agency might want to change from high-gloss to basketweave. A military unit might want to change from one camouflage style to another. Thus, there is a need in the art for a holster comprising multiple units such that a portion of the holster may be discarded without having to replace the entire holster.

In one exemplary embodiment, the holster comprises a containing means, a cover adapted to fit about the containing means, and a securing means that selectively holds the cover in a desired position about the containing means. In preferred exemplary embodiments, the containing means may be three dimensional and define a cavity (e.g., a pocket) for containing an item. For example, the containing means may be a compartment substantially open on at least one side where the compartment is shaped to contain a specific item including but not limited to a gun, a magazine, a knife, a baton or impact weapon, chemical agent, ammunition for gun, a flashlight, handcuffs, protective gloves, an electrical discharge stunning device, a recorder, pager, radio, pda, telephone, and other similar communication and computing devices and batteries for them. The cover may have a shape that corresponds to the three-dimensional shape of the containing means. In preferred exemplary embodiments, the securing means holds the cover about the outer portion of the containing means until it is desired that the cover be removed. The securing means may comprise a screw, snap, hook & loop with removable adhesive, clamp, etc. In an exemplary embodiment, a replacement cover may be applied to the containing means and selectively held in place by the securing means. For example, the replacement cover may be substantially the same as the preceding cover. However, in alternative embodiments, the replacement cover may be different than the preceding cover such as in size, shape, color, or other material characteristics.

BRIEF DESCRIPTION OF THE DRAWINGS

FIG. 4A shows an exemplary embodiment of a screw that may be utilized as a securing means for an exemplary screw post that may be utilized in some exemplary embodiments while

FIG. 7 shows a front perspective view of an exemplary containing means comprising a retention strap shown selectively connected to the containing means cover;

FIG. 8 shows a back perspective view of the exemplary holster of FIG. 8 comprising a thumb break strap connected to the exemplary containing means;

FIG. 9A shows a top perspective view of exemplary components of a holster while

DETAILED DESCRIPTION OF EXEMPLARY EMBODIMENT(S)

Figure 1:
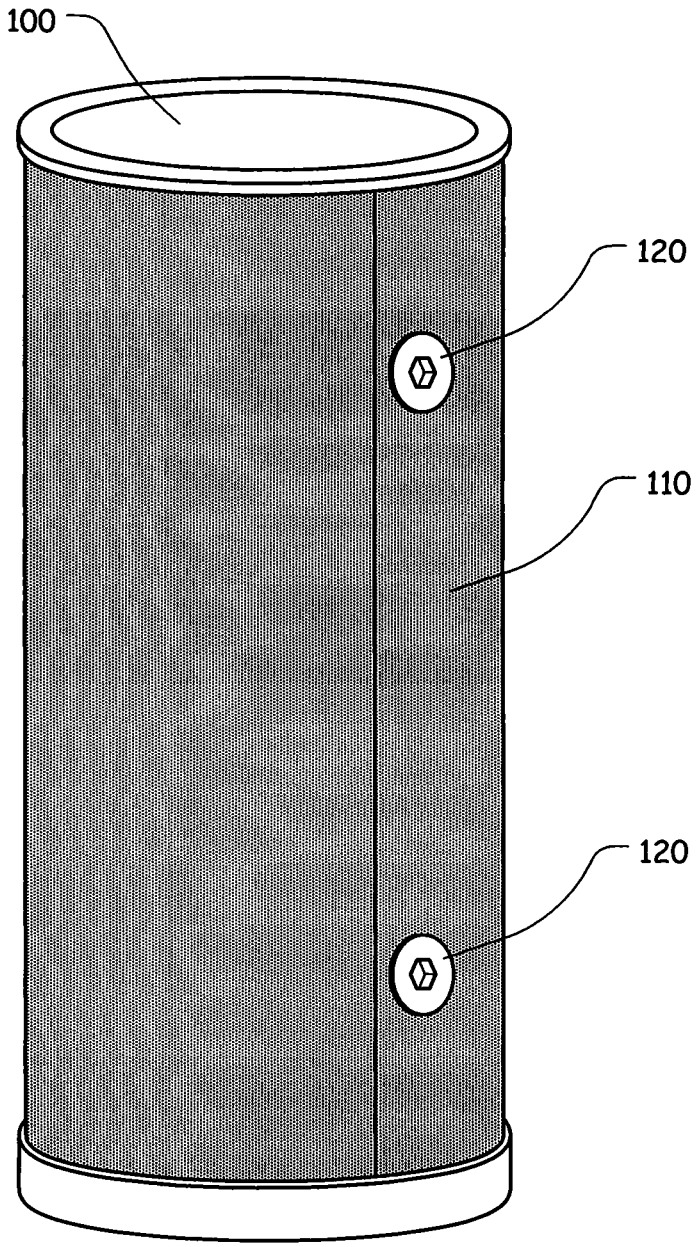
FIG. 1 shows a back perspective view of an exemplary embodiment of a holster.

As shown in FIG. 1, an exemplary embodiment of a holster comprises a containing means 100, a cover 110 adapted to fit about the containing means, and a securing means 120 that selectively holds the cover 110 in a desired position about the containing means 100. In preferred exemplary embodiments, the containing means 100 is three dimensional and defines a cavity for containing an item. In one exemplary embodiment, the containing means 100 may be a case or a pouch for containing multiple items rather than a holster for containing a single item. The containing means 100 may be a compartment substantially open on at least one side, where the compartment is shaped to contain a specific item such as a gun, knife, baton, magazine, chemical agent, power tool, toy gun, etc. The cover 110 may have a shape that substantially corresponds to the three-dimensional shape of the containing means 100. In some exemplary embodiments, the containing means has an inside surface and an outside surface where the inside surface defines a cavity for containing an item or items, and the cover substantially covers the outside of the containing means when the cover has been selectively positioned about the containing means. In another exemplary embodiment where the containing means has an inside surface and outside surface, the cover may be adapted to fit about a portion of the outside surface. When the holster is adapted to be worn by a user, the cover may be adapted to fit about the portion of the containing means' outside surface that faces away from the body of the user when worn. In preferred exemplary embodiments, the securing means 120 holds the cover 110 about the outer portion of the containing means 100 until it is desired that the cover 110 be removed. In some exemplary embodiments, the securing means 120 may comprise a screw, snap, hook & loop, clamp, adhesive, or other suitable fastening means.

Figure 2:
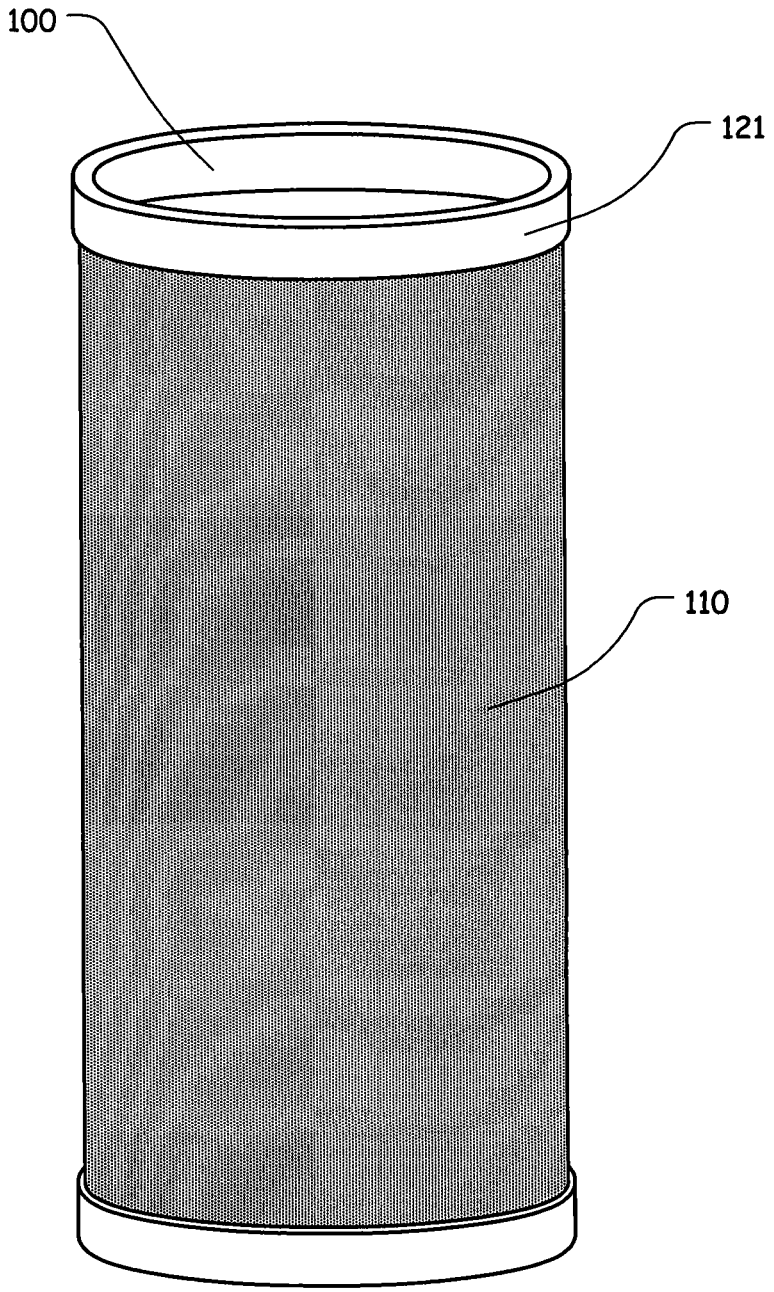
FIG. 2 shows a front perspective view of an exemplary embodiment where the securing means comprises an exemplary clamp.

In a second exemplary embodiment as shown in FIG. 2, a securing means 120 may comprise a clamp 121. The clamp 121 may be such that it fits about an entire edge of the containing means. In such an exemplary embodiment, the clamp 121 may form an edge for both the containing means and the cover when the securing means is selectively holding the cover in a desired position about the containing means.

Figure 3:
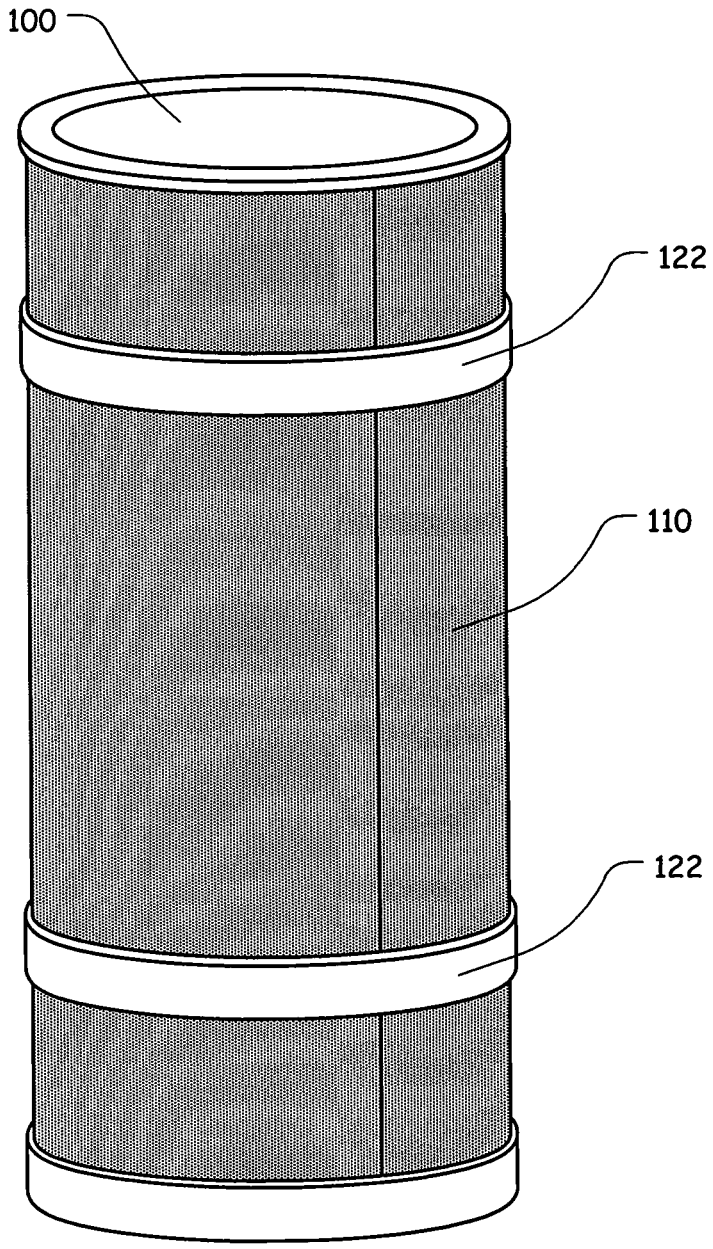
FIG. 3 shows a back perspective view of an exemplary embodiment where the securing means comprises an exemplary band.

In another exemplary embodiment, as shown in FIG. 3, a securing means may hold a cover in a desired place about a containing means without physically coming into contact with the containing means. For example, a securing means may be a band 122 that is placed about the cover, applying a force to the cover and holding the cover in a desired position. In yet another exemplary embodiment, the cover comprises a first edge and a second edge, and the securing means comprises a latch that is connected to the first edge of the cover and that can be selectively connected to the second edge of the cover when it is desired that the cover be held in place about the containing means.

Figure 4A:
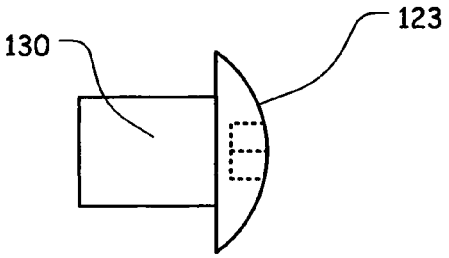
Figure 4B:
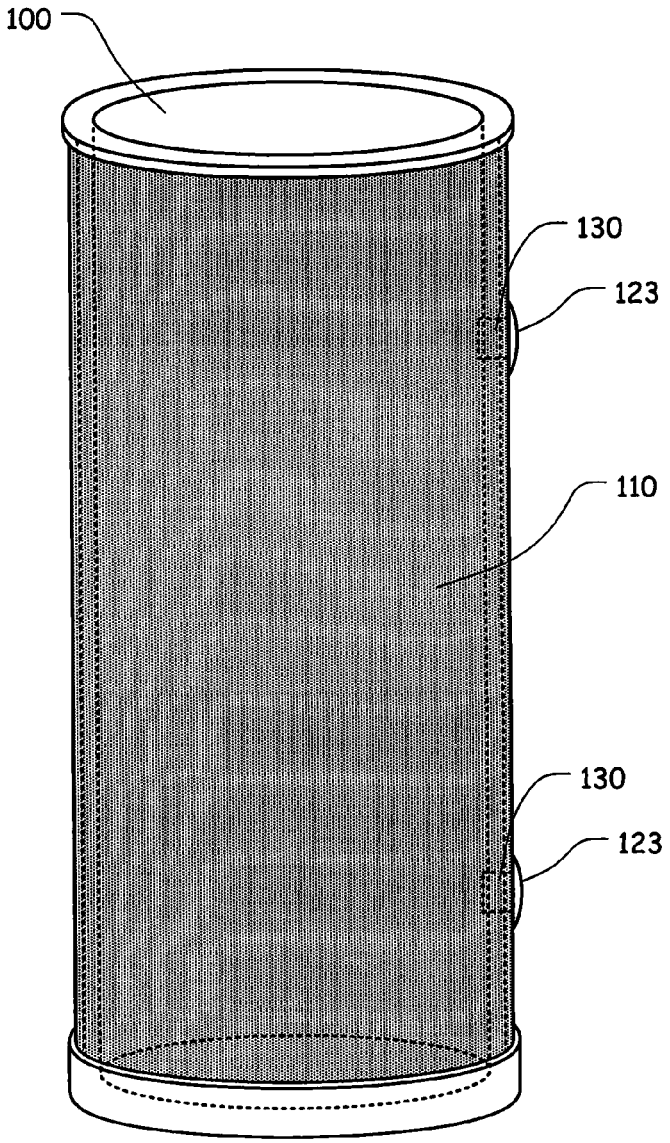
FIG. 4B shows an exemplary embodiment of a holster where the securing means comprises a screw being received by an exemplary screw post.

In one preferred exemplary embodiment, the securing means comprises a screw 123. In exemplary embodiments comprising a screw 123, the containing means and the cover may each define an opening adapted to receive the screw 123 such that when the screw 123 has been received by the holes of the containing means and the cover, the cover is held in a desired location about the containing means. In exemplary embodiments where the securing means comprises a screw 123, the containing means may comprise a screw post 130 where the screw post 130 prevents the end of the screw 123 from coming into contact with the contents of the holster. This may prevent a screw 123 from scratching a gun, knife, power tool, etc. that is being contained by the holster. The screw post 130 may, for example, comprise a polymeric material that cushions the screw 123 as well as the contents of the holster. In another exemplary embodiment, the screw post 130 may be made out of the same material as the containing means. FIGS. 4A and 4B show an exemplary embodiment of a screw post 130. In another exemplary embodiment where the securing means comprises a screw 123, the screw 123 may be such that it does not fully penetrate the containing means. In other words, the screw 123 may go completely through a cover and be received by an opening in a first side of the containing means where the opening does not fully extend between the first side of the containing means and a second side of the containing means. Such a configuration may prevent contents of the containing means from being scratched by the securing means.

In one exemplary embodiment, a containing means may be utilized with more than one cover. Various covers may comprise different images based on different applications of the holster. For example a first holster may be all black for use in the nighttime, while a second holster may be camouflage, and a third holster may comprise a reflective finish. In one exemplary embodiment comprising more than one cover, a first cover must be selectively removed from the containing means before a second cover can be selectively attached thereto.

In one exemplary embodiment, a holster further comprises a wearing means. The wearing means may permit an individual using the holster to wear it on his or her body. The wearing means may comprise a belt loop for duty use, belt loop for plain clothes, swivel belt loop attachment, shoulder harness, paddle attachment, clip, clamp, MOLLE-type or MOLLE-compatible device, tactical platform, straps and loops. In a preferred exemplary embodiment, the wearing means is connected to the containing means such that the cover can be selectively attached and detached from the containing means without having to disconnect the wearing means from the containing means. In another exemplary embodiment, a wearing means may be removed in order to selectively remove the cover from the containing means, and the wearing means may be re-secured to the containing means after or as a new cover is put in place on the containing means.

Figure 5:
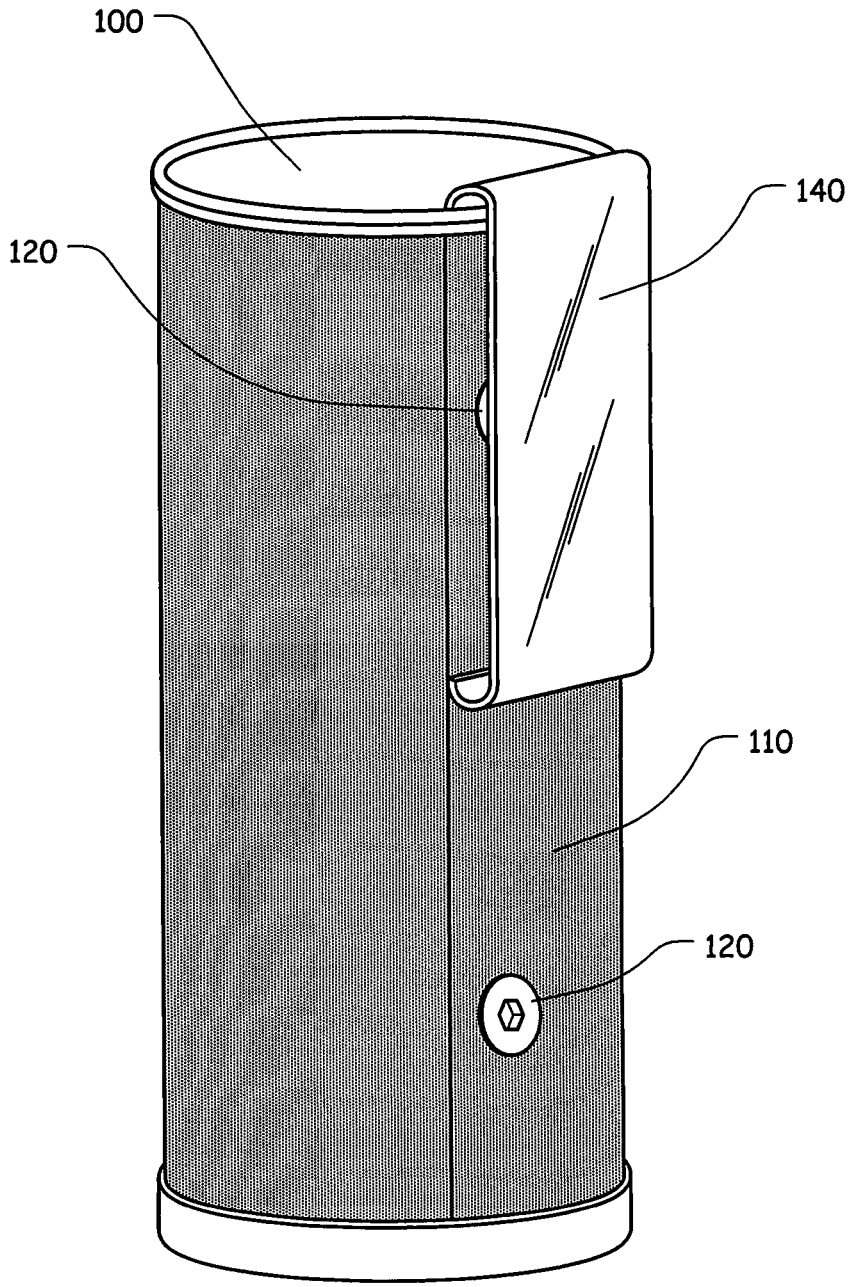
FIG. 5 shows a back perspective view of an exemplary embodiment of a holster comprising an exemplary wearing means.

In one exemplary embodiment, a securing means 120 selectively secures a cover 110 about a containing means 100 as well as selectively connects a wearing means 140 to the cover and/or containing means. The wearing means 140 may be a belt loop attachment as shown in FIG. 5. When a wearing means may be selectively connected to a cover and/or containing means by a securing means, the wearing means 140 may be replaced for a different wearing means when desired or needed. This may enable a holster to be utilized with a variety of types of wearing means. A variety of types of wearing means may be utilized with exemplary embodiments of the present invention. For example, belt loops for law enforcement use while on duty, belt loops for plain clothes concealment or sport use, swivel belt loops, shoulder harnesses, tactical vests, straps or loops for weaving the harness on a vest, belt, or tactical platform, belt and thigh attachments, etc. may all be utilized as wearing means. In another exemplary embodiment, a wearing means may be selectively or permanently secured to the containing means such that a cover may be removed and/or replaced without removing the wearing means.

Some exemplary embodiments comprise a containing means, a cover adapted to fit about the containing means, a first securing means for securing the cover to the containing means, and a second securing means for selectively attaching the cover to a holster accessory. A holster accessory may comprise a wearing means in some embodiments. In other exemplary embodiments, a holster accessory may be a hood, flap, thumb break, retention strap, etc. A tactical platform is typically woven with straps onto a vest, belt, thigh rig, etc. Thus, when a tactical platform is an accessory selectively attached to the cover, a user may be able to wear the holster on his or her body in a variety of ways. A hood is a retention device that helps retain a holstered firearm and is typically deactivated by a user with his or her thumb. In some exemplary embodiments, the second securing means may be utilized to selectively attach different types of accessories to the cover. Some exemplary embodiments comprise a containing means, a holster accessory connected to the containing means, a cover adapted to fit about the containing means, and a securing means for securing the cover to the containing means. In some embodiments, the containing means defines an inside surface, and the holster accessory is connected to the inside surface of the containing means. In other exemplary embodiments, the holster accessory is connected to the outside surface of the containing means. In exemplary embodiments where the holster accessory is connected to the outside surface of the containing means, the cover may define an opening that accommodates the holster accessory when the cover has been selectively attached to the containing means. In some exemplary embodiments, a holster attachment may be permanently attached to a containing means via sewing, adhesive, rivets, etc. In other exemplary embodiments, a holster accessory is selectively connected to a containing means via a securing means.

Figure 6:
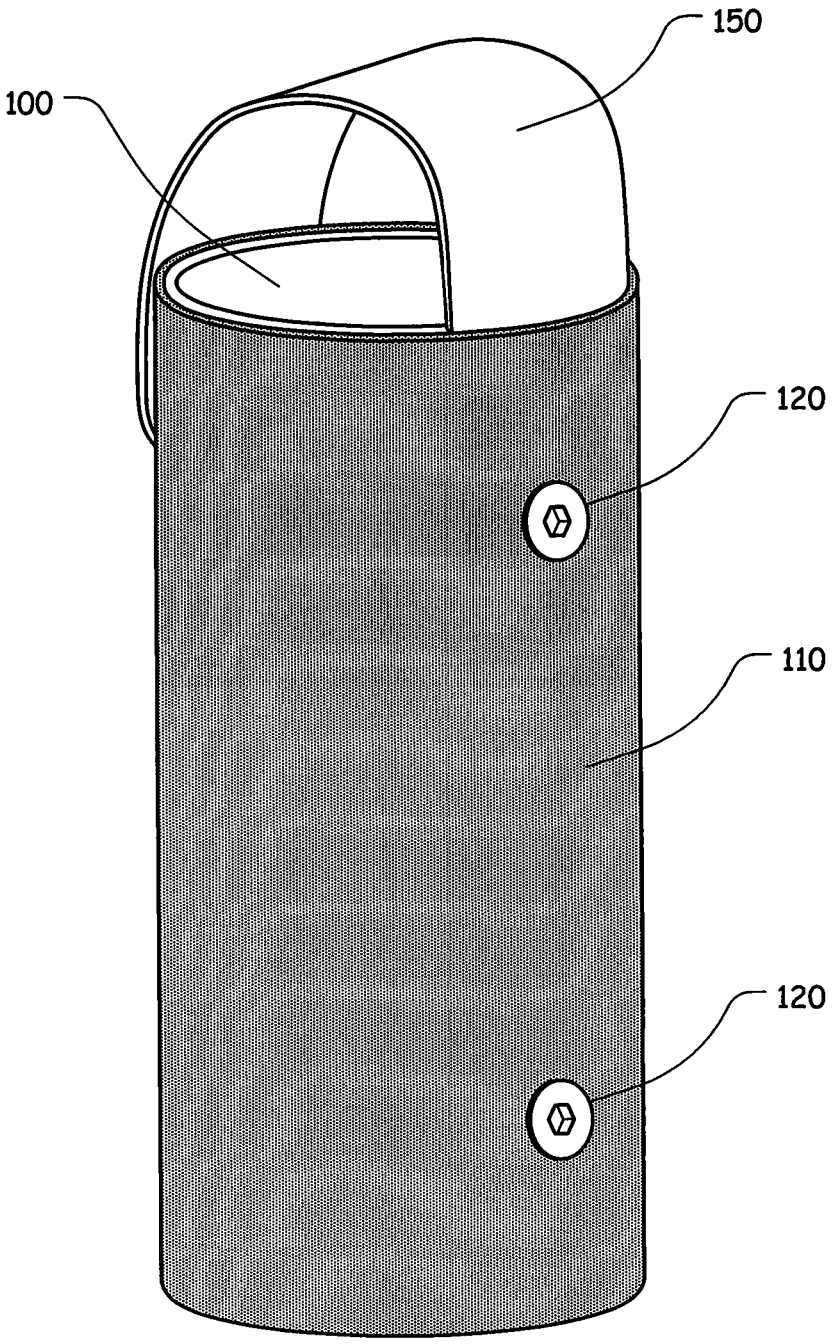
FIG. 6 shows a back perspective view of an exemplary holster comprising an exemplary flap that may be selectively detached from the containing means.

Such as shown in FIG. 6, one exemplary embodiment comprises a containing means 100 with an inner and outer surface, a cover 110 adapted to fit about the outer surface of the containing means, a flap 150 adapted to connect to the inner or outer surface of the containing means such that when connected a portion of the flap can be used to cover the contents of the containing means, and a securing means 120 that selectively holds the cover in a desired place about the containing means as well as selectively holds the flap in a desired position on the inner or outer surface of the containing means. Another exemplary embodiment comprises a containing means with an inner and outer surface, a cover adapted to fit about the outer surface of the containing means, a flap adapted to connect to the inner or outer surface of the containing means, a first securing means for selectively holding the cover in a desired location about the containing means, and a second securing means for holding the flap in a desired position on the inner or outer surface of the containing means. The first securing means and the second securing means do not necessarily have to be of the same type. For example, the first securing means may be a screw 123 that runs between the cover and the containing means when the cover is selectively attached to the containing means, while the second securing means may be a snap comprising a snapping member attached to the flap and a snapping member receiver attached to the inner or outer portion of the containing means. The second securing means may comprise hook & loop in some embodiments. In one exemplary embodiment where the second securing means comprises hook & loop, a flap may be selectively connected to the inside or outside of the containing means by the hook & loop.

Some exemplary embodiments comprising a flap may further comprise a flap closing means. The flap closing means may connect part of the flap to a desired location on the containing means so that the flap may be utilized to cover the contents of the containing means when the flap has been selectively attached to the containing means. A flap closing means may be a snap, hook & loop, tie, clamp, magnet, etc. that runs between the flap and the containing means when it is desired that at least part of the flap be held in a position on the containing means. It may be necessary to configure the cover such that it defines an opening for utilizing a flap closing means. In another exemplary embodiment, the flap closing means may connect part of the flap to a desired location on the cover so that the flap may be utilized to cover the contents of the containing means when the flap has been selectively attached to the cover. In such embodiments, a flap closing means may be a snap, hook & loop, tie, clamp, magnet, etc. that runs between the flap and the cover when it is desired that at least part of the flap be held in a position on the cover.

Some exemplary embodiments further comprise a retention strap 160 and thumb break 170. In a preferred exemplary embodiment as shown in FIG. 7, the retention strap 160 may be selectively attached to a containing means via a snap or other securing means where the securing means is received by a first opening or openings 210 defined by the retention strap. In exemplary embodiments comprising a cover, the retention strap may define a second opening or openings 220 for receiving a securing means that selectively connects the cover to the containing means. As shown in FIG. 8, the thumb break 170 may be selectively connected to the containing means on a side of the containing means that may be opposite the side to which the retention strap may be selectively connected. The thumb break 170 may be selectively connected to the containing means 100 via a second securing means that is received by a first opening or openings 220 defined by the thumb break. In exemplary embodiments comprising a cover, the thumb break may define a second opening or openings 230 for receiving a securing means that selectively connects the covering to the containing means. The exemplary embodiment may further comprise a cover adapted to fit about the containing means. The cover may fit about the retention strap and thumb break once they have been selectively connected to the containing means. As shown in FIGS. 7 and 8, the containing means may further define a first opening or openings 240 for receiving a securing means that secures the cover to the containing means and a second opening or openings 250 for receiving a securing means that selectively secures an accessory to the cover or containing means.

One exemplary embodiment may comprise a containing means, a cover comprising a first layer and a second layer where the cover is adapted to fit about the containing means, a thumb break, and a retention strap, where the thumb break and retention strap are selectively positioned between the first layer and second layer of the cover when the cover is selectively connected to the containing means via a securing means. In one exemplary embodiment, a securing means may be utilized to selectively hold each of the thumb break and the retention strap to the first layer of the cover. In further exemplary embodiments, a thumb break and retention strap may instead be positioned directly against the containing means or on the outside of the cover.

Another exemplary embodiment comprises a containing means with an inner and outer surface, a cover adapted to fit about the outer surface of the containing means, a securing means for selectively holding the cover in a desired position about the containing means, and a retention strap and thumb break connected to the containing means. In a preferred exemplary embodiment, the retention strap and thumb break are selectively connected to the cover or the containing means by a snap, tie, clamp, button, etc. In another exemplary embodiment, the retention strap and thumb break may be part of the containing means.

Figure 9A:
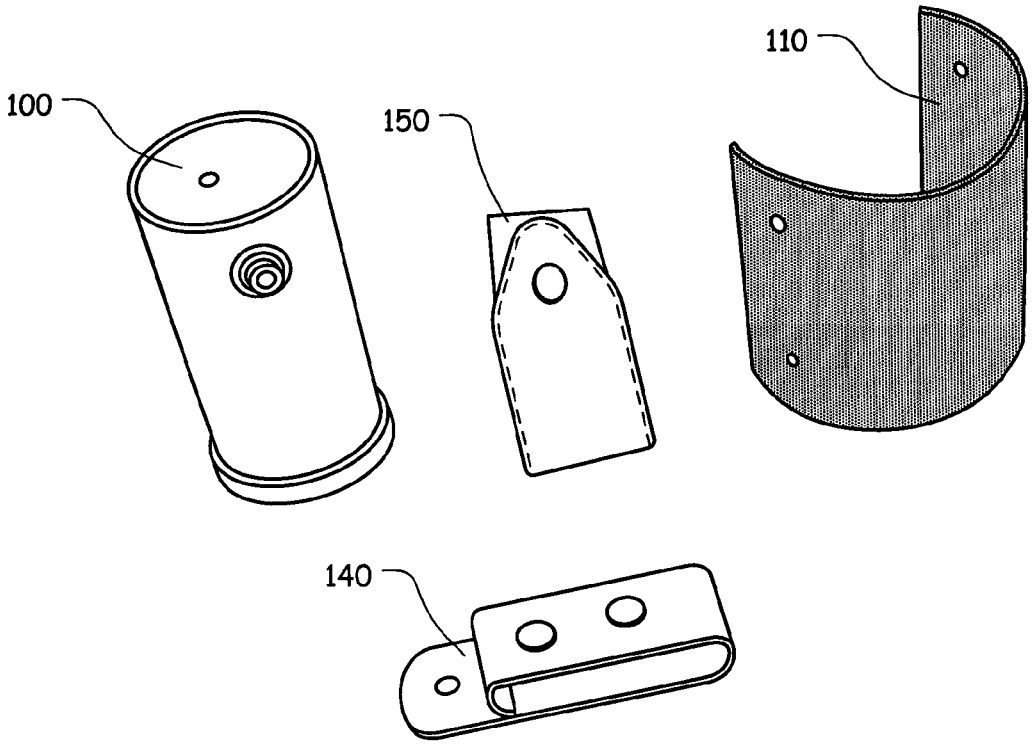
Figure 9B:
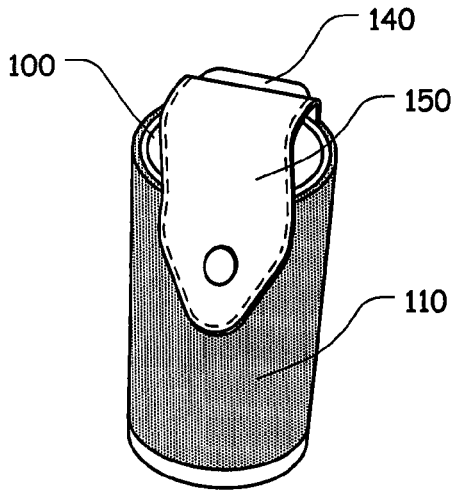
FIG. 9B shows an exemplary embodiment of how the exemplary components may be assembled into a holster.
Figure 10A:
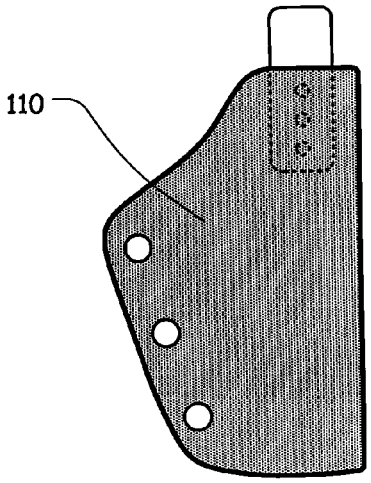
FIGS. 10A-10E show front plan views of a variety of exemplary holsters where 10A shows an exemplary embodiment having a containing means adapted to contain a gun; 10B shows an exemplary embodiment having a containing means adapted to contain expandable batons; 10C shows an exemplary embodiment having a containing means adapted to contain a radio; 10D shows an exemplary embodiment having a containing means adapted to contain a magazine; and 10E shows an exemplary embodiment having a containing means adapted to contain a chemical agent.
Figure 10B:
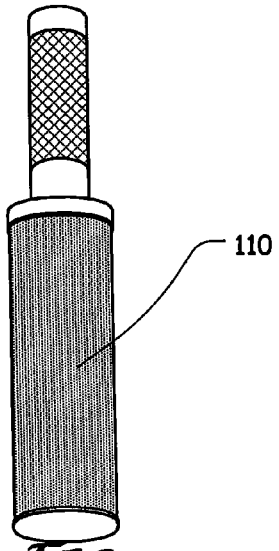
Figure 10C:
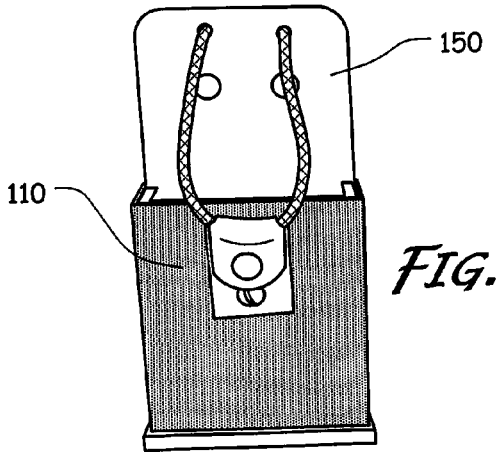
Figure 10D:
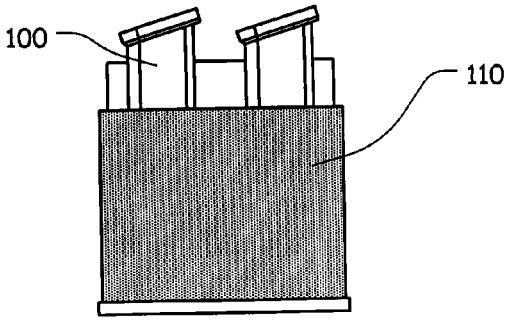
Figure 10E:
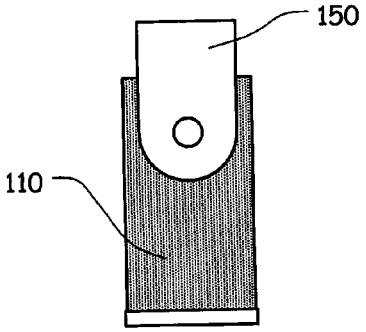
Figure 11:
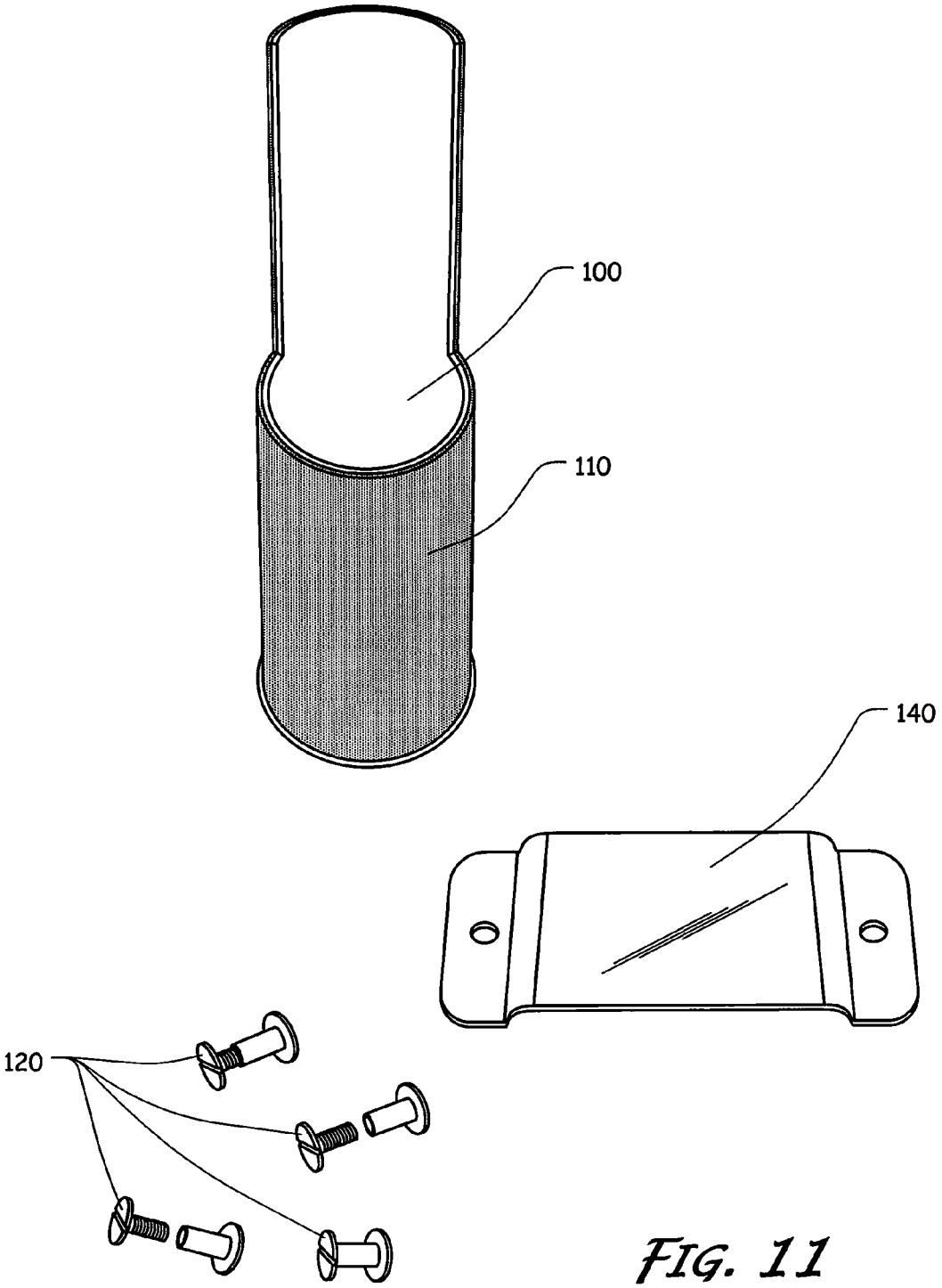
FIG. 11 shows an exemplary embodiment of components that may be assembled to form a holster for a light or aerosol.
Figure 12:
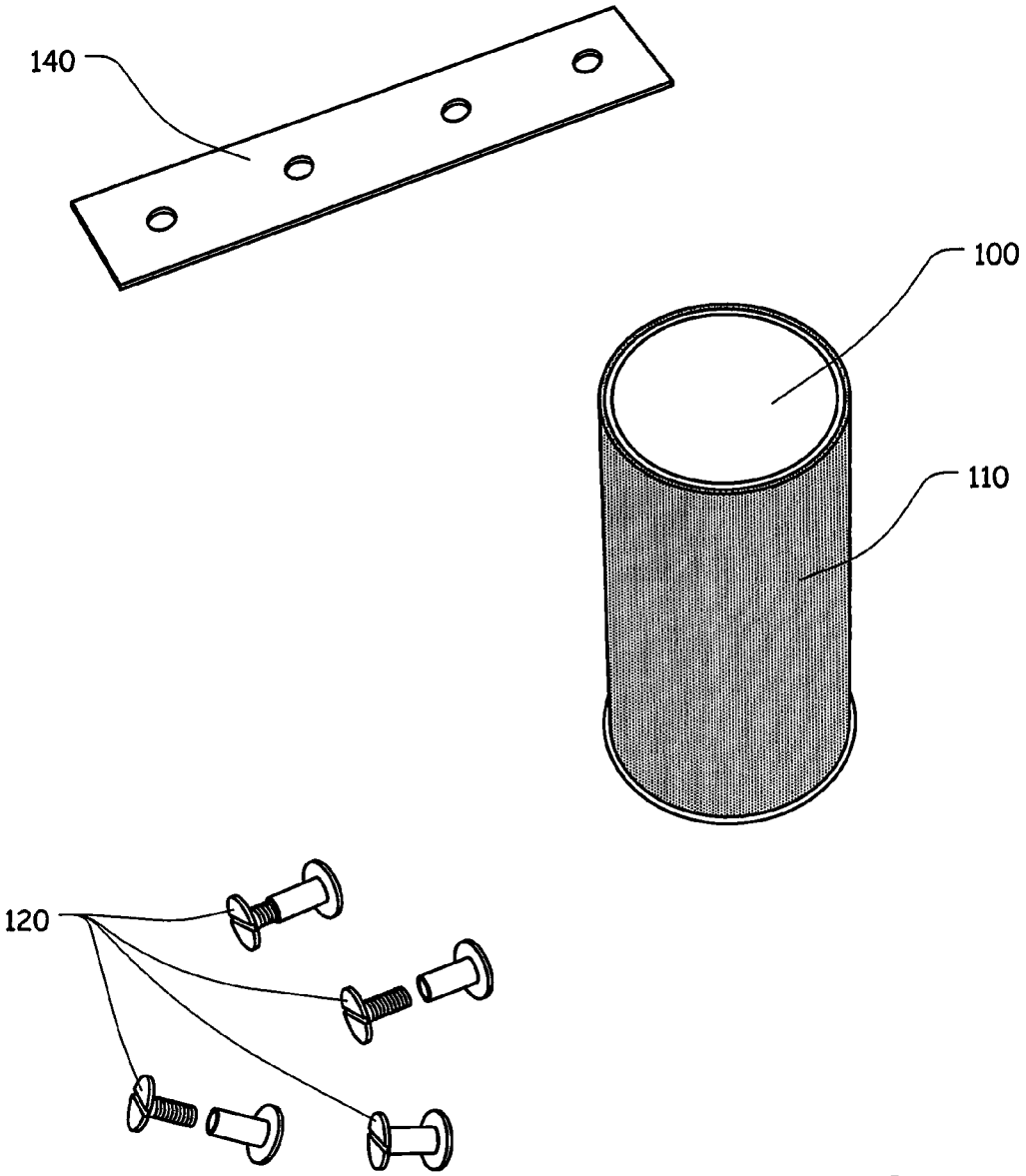
FIG. 12 shows an exemplary embodiment of components that may be assembled to form a holster for a baton.
Figure 13:
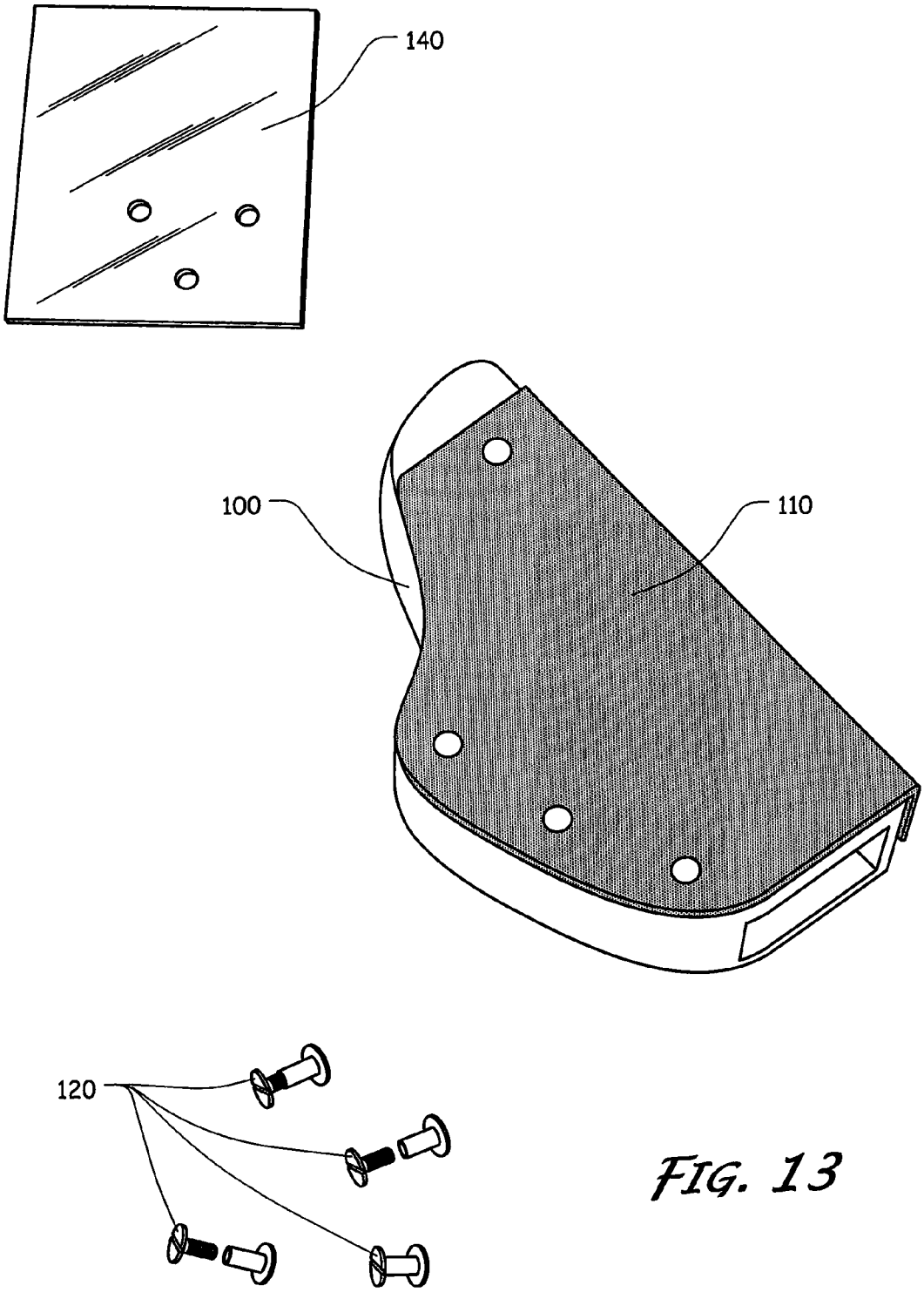
FIG. 13 shows an exemplary embodiment of a holster for a gun and an exemplary wearing means that may be selectively connected to the holster via the exemplary securing means shown.
Figure 14:
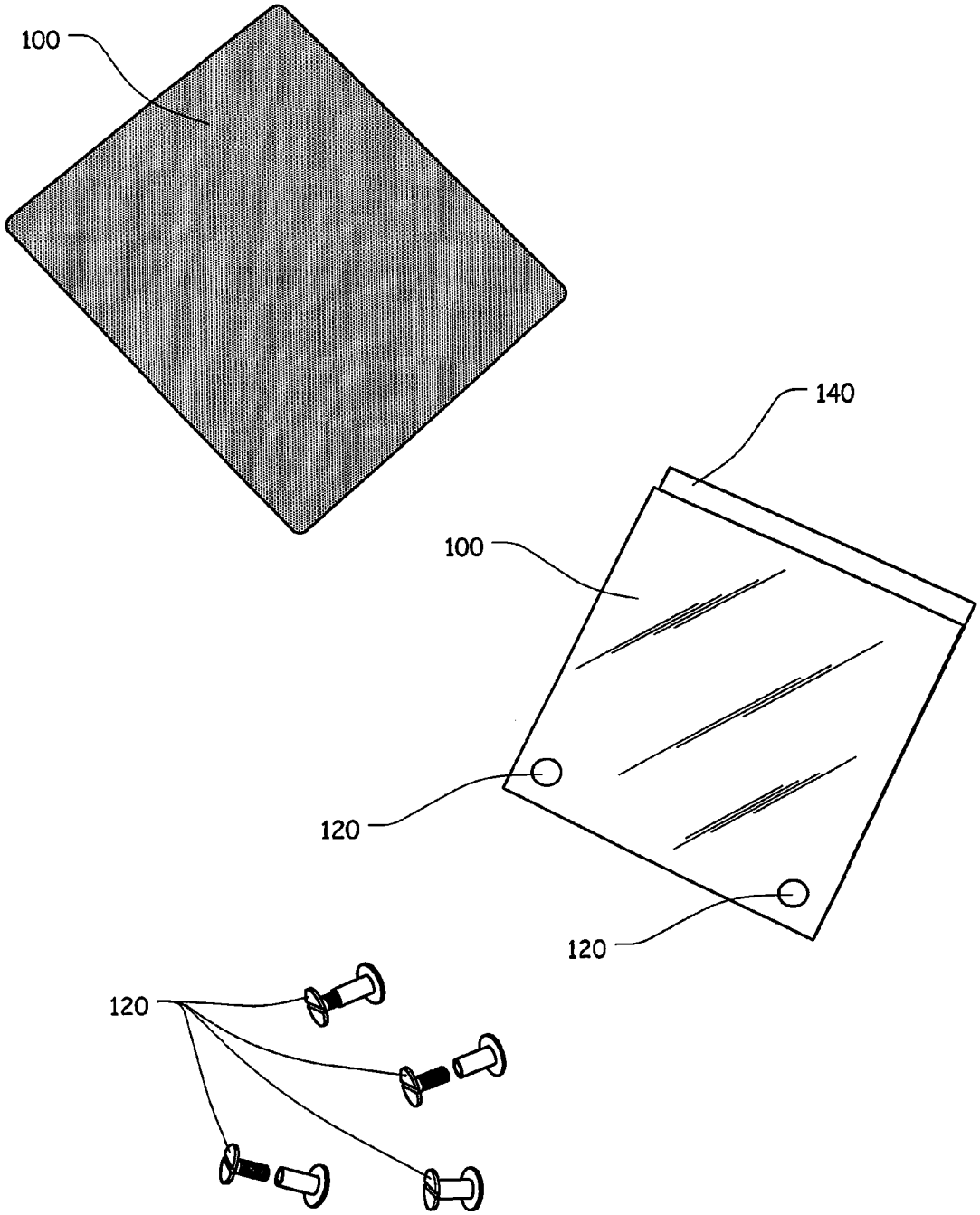
FIG. 14 shows an exemplary embodiment of components that may be assembled to form a holster for a pair of handcuffs.
Figure 15:
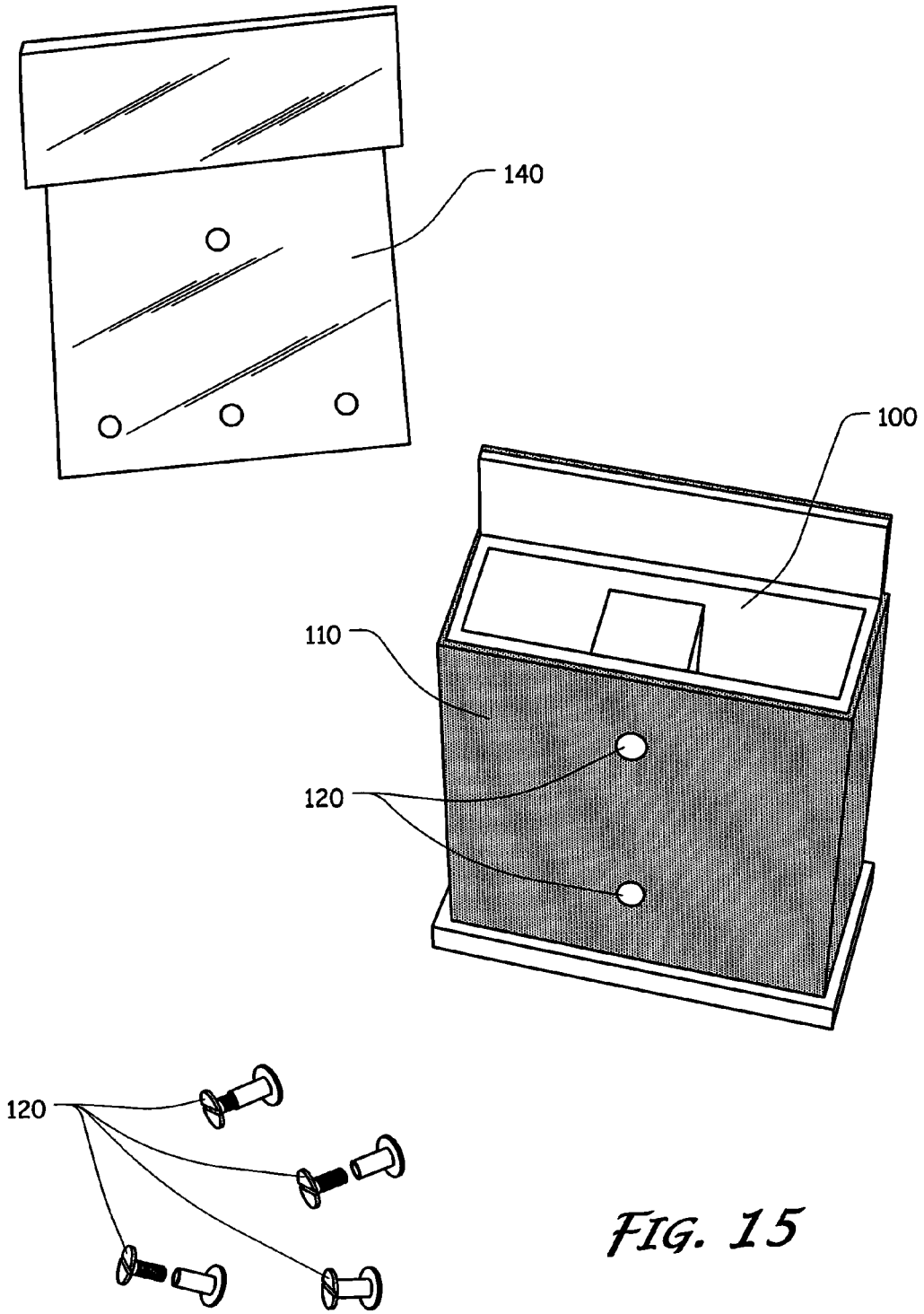
FIG. 15 shows an exemplary embodiment of components that may be assembled to form a magazine holster.
Figure 16:
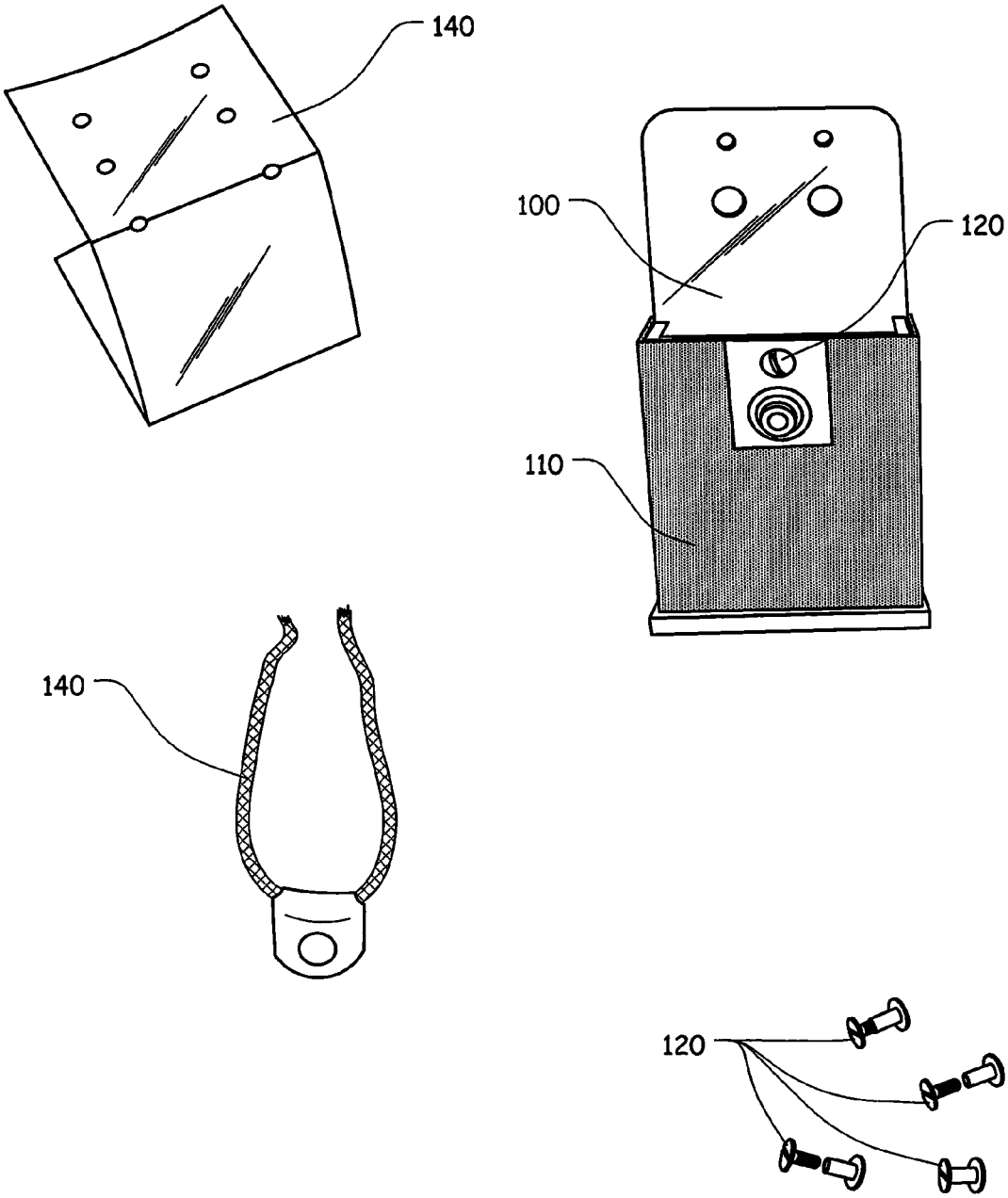
FIG. 16 shows an exemplary embodiment of components that may be assembled to form a radio case.

A preferred exemplary embodiment, as shown in FIGS. 9A and 9B, comprises several components that may be selectively unattached from each other. As shown in FIG. 9A, exemplary components of a holster may comprise a containing means 100, a cover 110, a wearing means 140, and a flap 150. FIG. 9B shows an exemplary embodiment of how the several components may be selectively assembled to form an exemplary holster. As shown in FIGS. 10A-10E, holsters may be configured to hold a variety of items. Exemplary embodiments include a holster where the containing means is configured to contain a gun (FIG. 10A), a baton (FIG. 10B), a radio (FIG. 10C), a magazine (FIG. 10D), a chemical agent, etc. (FIG. 10E), or any other suitable item. FIG. 11 shows a more detailed view of exemplary components that may be assembled to form a holster for a light or aerosol. FIG. 12 shows a more detailed view of exemplary components that may be assembled to form a holster for a baton. FIG. 13 shows a more detailed view of an exemplary holster for a gun shown with an exemplary wearing means 140 that may be selectively connected to the holster via a securing means. FIG. 14 shows a more detailed view of exemplary components that may be assembled to form a holster for handcuffs. FIG. 15 shows a more detailed view of exemplary components that may be assembled to form a holster for a magazine. Similarly, FIG. 16 shows a more detailed view of exemplary components that may be assembled to form a case for a radio.

In some exemplary embodiments, a cover that may be selectively attached to a containing means via a securing means is reversible. A cover may be made from a variety of materials. In some exemplary embodiments, a cover comprises more than one layer of material. Some covers may comprise layers of different types of materials. Some materials that may be utilized by a cover are synthetics such as polymers or kydex, woven materials such as nylon fabrics, leather, and bullet-resistant materials, etc. In a preferred exemplary embodiment, a cover comprises a first semi-rigid polymer layer and a second layer made from fabric or leather. The fabric or leather may be bonded to the polymeric layer via an adhesive, sewing, staple, etc. One or more layers of a cover may comprise bullet-resistant material.

In an exemplary embodiment, a containing means may be molded to form a rigid container for the item to be received therein (e.g., a gun), and to allow for easy insertion or removal of such item. In other exemplary embodiments, a containing means may be semi-rigid such that it defines and substantially retains a cavity of a specific shape. A semi-rigid containing means may be made from a polymer with low elasticity, a metal, etc. In some other exemplary embodiments, a containing means may be non-rigid. A non-rigid containing means may be made from a fabric, an elastic polymer, etc. A rigid or semi-rigid containing means may be preferable in that it may provide a better fit for contents of the containing means, minimize "play" within the containing means, enable easy insertion of contents into the containing means, make it more difficult for guns, a chemical agent, etc. that may be held in the containing means to be inadvertently engaged, and/or may be perceived as more attractive than a non-rigid containing means.

In one exemplary embodiment, a cover comprising a first side and a second side is reversible. When a cover comprising a first side and a second side is reversible, it may be selectively attached to a containing means such that either the first side or the second side is in contact with the containing means. A containing means that is reversible may have a first side with a first appearance and a second side with a second appearance. For example, the first side may comprise a reflective finish while the second side may comprise a camouflage finish, black finish, waterproof finish, etc.

One exemplary embodiment comprises a containing means and a cover where the cover is designed to be placed about the containing means. In this exemplary embodiment, the cover may be such that once placed about the containing means it will stay in a desired location until it is desired that the cover be removed. Application of an external force may be all that is required to remove the cover from the containing means. For example, the cover may have a sufficiently tight or frictional fit about the containing means, which may serve as the securing means optionally without the use of any other mechanical or adhesive fastener. In another exemplary embodiment, the containing means may comprise a reciprocal for receiving a portion of the cover when the cover is positioned about the containing means. Thus, the containing means and cover may be adapted to be selectively connected to each other without the assistance of an additional securing means. In one exemplary embodiment comprising a containing means and a cover adapted to fit about the containing means, the containing means may still be utilized to hold a gun, baton, power tool, etc. even after the cover has been selectively removed from about the containing means. In other words, removal of the cover may not affect the ability of the containing means to be utilized by a user for containing an item or items.

A further exemplary embodiment comprises a containing means, a cover adapted to fit about the containing means, and a holster accessory. In one exemplary embodiment, the holster accessory is selectively connected to the containing means by a securing means. In another exemplary embodiment, the accessory is permanently connected to the containing means. A permanent connection to the containing means may be made via sewing, adhesive, welding, a grommet, etc. When an accessory is connected to the containing means either selectively or permanently, it may be possible to remove the cover from about the containing means without removing the accessory from the containing means. In another exemplary embodiment, the accessory is connected to the cover by a securing means. In embodiments where the accessory is selectively connected to the cover, it may be possible to remove the cover from about the containing means without disconnecting the accessory from the cover. For example, one embodiment may comprise a containing means, a cover adapted to fit about the containing means, a first accessory connected to the containing means via a first securing means, and a second accessory connected to the cover via a second securing means.

Another exemplary embodiment may comprise a containing means and a cover adapted to fit about the containing means where the cover comprises a first and second layer. When a cover comprises a first and second layer, the second layer may substantially cover at least one entire side of the first layer. In such an embodiment, the second layer of the cover may endure wear and tear while protecting the first layer from exposure to elements that may degrade its quality, appearance, etc. It may be possible to selectively remove the second layer of the cover from the position in which it substantially covers at least one side of the first layer such that it no longer protects the first layer. Because the first layer has been protected from the elements by the second layer, the first layer of the cover may still look new. In one exemplary embodiment where a cover comprises a first and second layer, the first layer may be a permanent or removable layer while the second layer may be selectively removed from about the first layer and then replaced by a new second layer. In such an exemplary embodiment, the first cover layer may be connected to the containing means by a first securing means and the second cover layer may be connected to the first cover layer by a second securing means.

While certain embodiments of the present invention are described in detail above, the scope of the invention is not to be considered limited by such disclosure, and modifications are possible without departing from the spirit of the invention as evidenced by the claims. For example, various configurations of the containing means, cover, and wearing means and other accessories may be implemented and fall within the scope of the claimed invention. Various fasteners may be utilized as securing means and still fall within the scope of the claims invention. One skilled in the art would recognize that such modifications are possible without departing from the scope of the claimed invention.

The invention claimed is:

1. A holster comprising:

a containing means comprising an inside surface and an outside surface wherein said inside surface defines a cavity configured to retain at least a portion of an item, wherein said outside surface of said containing means includes first ridge segment formed proximate an upper portion of said containing means and a second ridge segment formed proximate a lower portion of said containing means, and wherein a recessed portion of said containing means is formed between said first ridge segment and said second ridge segment;

a cover adapted to be selectively attached to and fit about at least a portion of said outside surface of said containing means, within at least a portion of said recessed portion of said container, and two or more apertures formed in said cover so as to provide at least one aligned, overlapping aperture when said cover is wrapped about said containing means;

a wearing means adapted to be selectively connected to and removed from said containing means; and a fastener, wherein said fastener passes through said at least one aligned, overlapping aperture in said cover and at least one aligned aperture in said wearing means, and wherein said fastener releasably holds said cover in a desired location on said containing means and releasably holds said wearing means in a desired position on said containing means.

2. The holster of claim 1 wherein said cover covers substantially all of said outside surface of said containing means.

3. The holster of claim 1, wherein said first ridge segment forms an upper portion of said containing means and wherein said second ridge segment forms a lower portion of said containing means.

4. The holster of claim 1 where said containing means is adapted to contain an item selected from a group consisting of a gun, a magazine, a knife, a baton or impact weapon, chemical agent, ammunition for a gun, a flash light, handcuffs, protective gloves, an electrical discharge stunning device, a recorder, a pager, a radio, a personal digital assistant, and a telephone.

5. The holster of claim 1 wherein said cover comprises a first side and a second side where said cover can be selectively attached to said containing means with either said first side or said second side being in contact with said outside surface of said containing means such that said side in contact with said outside surface is not said side of said cover that is perceivable when said holster is being utilized.

6. The holster of claim 1 wherein said cover cannot overlie said cavity of said container.

7. A holster comprising:

a containing means defining a cavity for containing an item, wherein an outside surface of said containing means includes first ridge segment formed proximate an upper portion of said containing means and a second ridge segment formed proximate a lower portion of said containing means, and wherein a recessed portion of said containing means is formed between said first ridge segment and said second ridge segment;

a cover adapted to be selectively attached to and fit about at least a portion of said outside surface of said containing means, within at least a portion of said recessed portion of said container, and two or more apertures formed in said cover so as to provide at least one aligned, overlapping aperture when said cover is wrapped about said containing means;

a flap adapted to be selectively connected to and removed from said containing means;

a wearing means adapted to be selectively connected to and removed from said containing means; and a fastener, wherein said fastener passes through said at least one aligned, overlapping aperture in said cover, and at least one aligned aperture in said flap, and at least one aligned aperture in said wearing means, and wherein said fastener releasably holds said cover in a desired location on said containing means, releasably holds said flap in a desired position on said containing means, and releasably holds said wearing means in a desired position on said containing means.

8. The holster of claim 7 wherein said wearing means is selected from a group consisting of a belt loop for duty use, a belt loop for plain clothes, a swivel belt loop attachment, a shoulder harness, a paddle attachment, a clip, a clamp, a MOLLE-type or MOLLE-compatible device, a tactical platform, a detachable belt loop, and a strap.

9. The holster of claim 7 wherein said cover comprises a first side and a second side where said cover can be selectively attached to said containing means with either said first side or said second side being in contact with said containing means such that it is not said side of said cover that is perceivable when said holster is being utilized.

10. The holster of claim 9 wherein said first side of said cover comprises a surface or finish that reflects light and said second side of said cover comprises a surface or finish that is not reflective.

11. The holster of claim 7 wherein said fastener comprises a screw.

12. The holster of claim 11 wherein said screw is received by a screw post that runs through said cover and said containing means when said fastener is selectively holding said cover in said desired location on said containing means.

13. The holster of claim 7 wherein said fastener selectively holds said flap in a desired position on an inner surface or an outer surface of said containing means.

14. The holster of claim 7, wherein when said cover is attached to said outside surface of said containing means, said cover cannot overlie said cavity of said container.

15. The holster of claim 7 wherein said containing means is adapted to hold an item selected from a group consisting of a gun, a magazine, a knife, a baton or other impact weapon, a chemical agent, ammunition for a gun, and a flash light.

16. A holster comprising:

a container defining a cavity, wherein an outside surface of said container includes first ridge segment formed proximate an upper portion of said container and a second ridge segment formed proximate a lower portion of said container, and wherein a recessed portion of said container is formed between said first ridge segment and said second ridge segment;

a cover adapted to be selectively attached to and fit about at least a portion of said container, within at least a portion of said recessed portion of said container, and two or more apertures formed in said cover so as to provide at least one aligned, overlapping aperture when said cover is wrapped about said containing means;

a wearing means adapted to be selectively connected to and removed from said container; and a fastener, wherein said fastener passes through said at least one aligned, overlapping aperture in said cover and at least one aligned aperture in said wearing means, and wherein said fastener releasably holds said cover in a desired location on said container and releasably holds said wearing means in a desired position relative to said container.

17. The holster of claim 16 wherein said fastener applies a force to said cover to hold said cover in a desired location on said container.

18. The holster of claim 16 wherein said cover comprises a first side and a second side, and wherein said cover can be selectively attached to said container with either said first side or said second side being in contact with said container.

19. The holster of claim 18 wherein said first side of said cover comprises a surface or finish that reflects light and said second side of said cover comprises a finish or surface that is not reflective.

20. The holster of claim 16 wherein when said cover is attached to said outside surface of said containing means, said cover cannot overlie said cavity of said container.

* * * * *